US005227286A

United States Patent [19]

Kuno et al.

[11] Patent Number: 5,227,286

[45] Date of Patent: Jul. 13, 1993

[54] SILVER HALIDE PHOTOGRAPHIC MATERIAL

[75] Inventors: Koichi Kuno; Shuzo Suga, both of Kanagawa, Japan

[73] Assignee: Fuji Photo Film Co., Ltd., Kanagawa, Japan

[21] Appl. No.: 700,238

[22] Filed: May 15, 1991

[30] Foreign Application Priority Data

May 15, 1990 [JP] Japan ..... 2-124727

[51] Int. Cl.[5] ..... G03C 1/76

[52] U.S. Cl. ..... 430/539; 430/523; 430/567; 430/604; 430/605

[58] Field of Search ..... 430/567, 604, 605, 523, 430/539

[56] References Cited

U.S. PATENT DOCUMENTS

| | | | |
|---|---|---|---|
| 4,288,535 | 9/1981 | Kanisawa et al. | 430/605 |
| 4,369,245 | 1/1983 | Beruto et al. | 430/539 |
| 4,469,783 | 9/1984 | Kuwabara et al. | 430/605 |
| 4,621,041 | 11/1986 | Saikawa et al. | 430/605 |
| 4,693,965 | 9/1987 | Ihama et al. | 430/605 |
| 4,705,747 | 11/1987 | Klotzer et al. | 430/538 |
| 4,746,603 | 5/1988 | Yamashita et al. | 430/605 |
| 4,828,962 | 5/1989 | Grzeskowiak | 430/605 |
| 4,897,342 | 1/1990 | Kajiwara et al. | 430/605 |
| 4,902,611 | 2/1990 | Leubner et al. | 430/605 |
| 5,024,932 | 6/1991 | Tanji et al. | 430/539 |
| 5,164,292 | 11/1922 | Johnson et al. | 430/605 |

FOREIGN PATENT DOCUMENTS

| | | |
|---|---|---|
| 0264288 | 4/1988 | European Pat. Off. . |
| 0316864 | 5/1989 | European Pat. Off. . |
| 0336426 | 10/1989 | European Pat. Off. . |
| 0359483 | 3/1990 | European Pat. Off. . |

*Primary Examiner*—Jack P. Brammer

*Attorney, Agent, or Firm*—Sughrue, Mion, Zinn, Macpeak & Seas

[57] ABSTRACT

A silver halide photographic element with high sensitivity and less processing reliance in a high-illuminance and short-time light exposure which can be processed quickly is provided. The photographic element comprises at least one light-sensitive silver halide emulsion layer which has silver halide grains containing an iridium compound and at least one light-insensitive hydrophilic colloid layer.

7 Claims, No Drawings

SILVER HALIDE PHOTOGRAPHIC MATERIAL

FIELD OF THE INVENTION

The present invention relates to a silver halide photographic material and a processing method thereof, and more particularly to a silver halide photographic material which is highly sensitive and excellent in processing reliance in a high-illuminance and short-time exposure and can be quickly processed, and to a processing method for the photographic material.

BACKGROUND OF THE INVENTION

Recently, a scanner system has been used widely in the field of making a printing plate. There are various recording apparatus for a scanner system in an image-forming system and a suitable recording light source of the the scanner system include a glow lamp, a xenon lamp, a tungsten lamp, a light emitting diode (LED), a He-Ne laser, an argon laser and a semiconductor laser.

Photographic light-sensitive materials used in a scanner system require various characteristics and, in particular, because in a scanner system the light-sensitive material is exposed at a very short exposure of from $10^{-3}$ to $10^{-7}$ second , it is necessary that the photographic light-sensitive material shows a high sensitivity and high contrast even under such conditions.

However, a silver halide emulsion exposed in a high-illuminance and short time generally is liable to cause development proceeding and thus, a feature that when the composition of the processing solutions or the developing temperature and time deviate a marked deviation in the sensitivity results.

Furthermore, it has been strongly desired to increase the efficiency and speed of work, and there are wide needs for increasing the scanning speed and shortening the processing time of photographic light-sensitive materials in the printing field.

For meeting the needs in the printing field, in a light exposure apparatus (such as a scanner and plotter), it is desirable to increase the scanning speed and to increase the line number and sharpen the beam for improving the image quality, and also in a silver halide photographic material, it is desirable that the photographic light-sensitive material has a high sensitivity, is excellent in processing stability and can be quickly processed.

The term "quick processing process" in the invention means the photographic processing method wherein the time required for the leading edge of a film being processed from its entering an automatic processor to emerging from the drying section after passing through a developing bath, a transferring portion, a fixing bath a transferring portion, a wash bath and a drying portion is from 15 to 60 seconds.

SUMMARY OF THE INVENTION

An object of the invention is, therefore, to provide a silver halide photographic material which has high sensitivity and less processing reliance even in a high-illuminance and short-time light exposure and which can be processed quickly and to provide a processing method of the photographic light-sensitive material.

It has now been discovered that the above-described object can be achieved by the present invention as set forth hereinbelow.

There is provided in the present invention a silver halide photographic material comprising a support having thereon at least one light-sensitive silver halide emulsion layer and at least one light-insensitive hydrophilic colloid layer, wherein the amount of gelatin and the coated amount of silver on the side of the support having the light-sensitive silver halide emulsion layer and the light-insensitive hydrophilic colloid layer is not more than 2.5 g/m$^2$ and is less than 3.0 g/m$^2$, respectively, and the silver halide grains contain at least 30 mol % silver chloride, not more than 5 mol % silver iodide and not more than $10^{-6}$ mol of an iridium compound per mole of the silver halide formed.

DETAILED DESCRIPTION OF THE INVENTION

The silver halide photographic emulsion of the invention contains silver chloride, silver bromide or silver chloroiodobromide. The silver halide photographic emulsion contains at least 30 mol %, and preferably at least 60 mol % silver chloride. Also, the content of silver iodide is not more than 5 mol %, and preferably not more than 2 mol %.

The form of the silver halide grains may be cubic, tetradecahedral, octahedral, amorphous, or tabular but is preferably cubic or tabular, The mean grain size of the silver halide is preferably from 0.01 μm to 1 μm, and more preferably less than 0.4 μm and also the grain size distribution is preferably narrow to an extent that the coefficient of variation shown by the formula $$(A)/(B)\times 100$$

(A): Standard deviation of grain size
(B): Mean grain size is preferably lower than 15%, and more preferably lower than 10%.

The silver halide grains may be composed of a uniform phase throughout the whole grain or may differ in phase between the inside and the surface.

The photographic emulsion for use in this invention can be prepared by the well known conventional manner, described in P. Glafkides, *Chimie et Physique Photographique,* published by Paul Montel Co., 1967; G. F. Duffin, *Photographic Emulsion Chemistry,* published by The Focal Press, 1966, V. L. Zelikman et al, *Making and Coating Photographic Emulsion,* published by The Focal Press, 1964, etc.

That is, the photographic emulsion may be prepared by an acid method, a neutralization method, an ammonia method etc., and as a system of reacting a soluble silver salt and a soluble halide, a single jet method, a double jet method or a combination may be used.

A so-called reverse mixing method of forming silver halide grains in the existence of excessive silver ions can be used.

Furthermore, as one system of the double jet method, a so-called controlled double jet method, that is, the method of keeping constant pAg in the liquid phase that forms the silver halide can be used.

The photographic emulsion, thus formed, may be coated on a support in the well known method. According to the method, a silver halide emulsion containing silver halide grains having a regular crystal form and almost uniform grain sizes is obtained.

Also, for obtaining silver halide grains having uniform grain size, it is preferred to form the silver halide grains quickly in a range of not over the critical saturation by using the method of changing the addition rates of silver nitrate and an alkali metal halide in proportion to the growing rate of the silver halide grains as described in British Patent 1,535,016, JP-B-48-26890 and JP-B-52-163364 (the term "JP-B" as used herein mean an "examined published Japanese patent application") or a method of changing the concentrations of aqueous solution being added as described in U.S. Pat. No. 4,242,445 and JP-A-55-158124 (the term "JP-A" as used herein means an "unexamined published Japanese patent application").

It is preferred that the grain formation of the silver halide emulsion for use in this invention is carried out in the presence of a silver halide solvent such as 4-substituted thiourea and organic thioether compounds.

The 4-substituted thiourea which is used preferably as the silver halide solvent is a compound Shown by the following general formula described in JP-A-53-82408 and JP-A-55-77737;

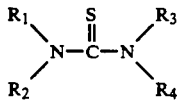

wherein $R_1$, $R_2$, $R_3$ and $R_4$, which may be the same or different, each represents a substituted or unsubstituted alkyl group, a substituted or unsubstituted alkenyl group ( such as allyl etc.), or a substituted or unsubstituted aryl group, the sum of the carbon numbers of $R_1$, $R_2$, $R_3$ and $R_4$ is preferably not more than 30, and said $R_1$ and $R_2$, said $R_2$ and $R_3$, or said $R_3$ and $R_4$ may combine with each other to form a 5- or 6-membered heterocyclic imidazolidinethione, piperidine, morpholine etc. The above-described alkyl group may be straight chain or branched.

As the substituent of the substituted alkyl group, there is, for example, a hydroxy group (—OH), a carboxy group, a sulfonic acid group, an amino group, an alkoxy group (O-alkyl) wherein the alkyl residue has from 1 to 5 carbon atoms, a phenyl group or a 5- or 6-membered heterocyclic ring (furan, etc.). As the substituent of the substituted aryl group, there is a hydroxy group, a carboxy group or a sulfonic acid group.

In this case, it is particularly preferred that at least 3 of $R_1$, $R_2$, $R_3$ and $R_4$ are an alkyl group, each alkyl group has from 1 to 5 carbon atoms, the aryl group is a phenyl group and the sum of the carbon atom numbers of $R_1$, $R_2$, $R_3$ and $R_4$ is not more than 20.

Specific examples of the compound shown by the aforesaid formula are illustrated below.

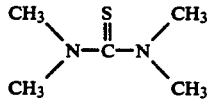

(1)

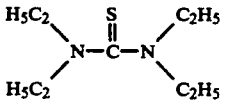

(2)

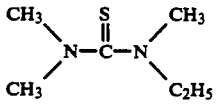

(3)

-continued

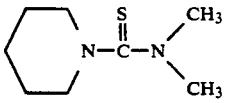

(4)

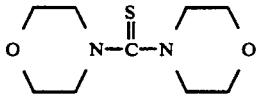

(5)

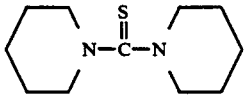

(6)

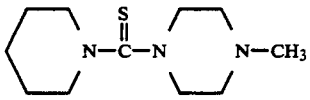

(7)

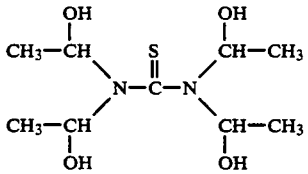

(8)

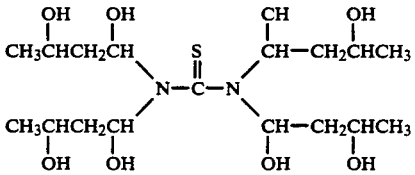

(9)

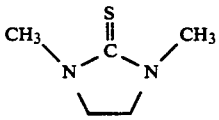

(10)

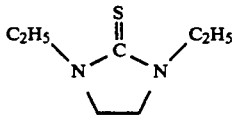

(11)

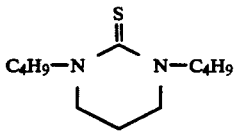

(12)

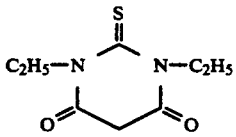

(13)

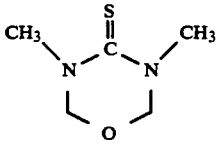

(14)

-continued (15)

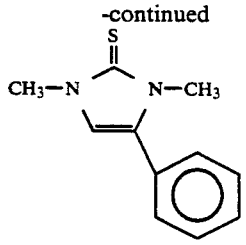

(16)

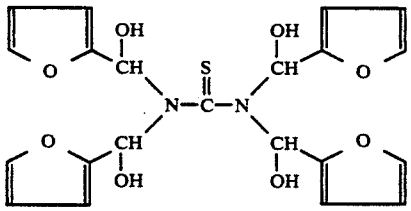

As the organic thioether compound which is preferably used as a silver halide solvent in this invention, there are the compounds each having at least one group wherein an oxygen atom is separated from a sulfur atom with ethylene (e.g., —O—$CH_2CH_2$—S—) described in U.S. Pat. No. 3,574,628 and the chain-form thioether compounds each having alkyl groups (the alkyl groups each having at least two substituents selected from hydroxy, amino, carboxy, amido, and sulfo) at both ends (terminals) as described in U.S. Pat. No. 4,276,374. Specific examples of the organic thioether compound are illustrated below.

$HOCH_2CH_2—S—CH_2CH_2—S—CH_2CH_2OH$ $HOCH_2CH_2CH_2—S—CH_2CH_2—S—CH_2CH_2CH_2OH$ $HOCH_2CH(OH)CH_2SCH_2CH_2SCH_2CH(OH)CH_2OH$ $HOOCCH_2CH(OH)CH_2—S—CH_2CH_2—S—CH_2CH(OH)CH_2COOH$

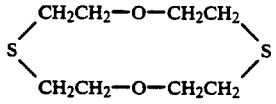

The amount of the silver halide solvent added depends upon the kind of the compound being used, the desired grain size and halogen composition of the silver halide grains, but is preferably from $1\times10^{-5}$ to $1\times10^{-2}$ mol per mol of silver halide.

When the grain sizes of the silver halide grains formed become larger than the desired size grain size can be controlled by changing the temperature at grain formation and the addition times of an aqueous silver salt solution and an aqueous halide solution.

As an iridium compound being used in this invention, a water-soluble iridium compound can be used.

The iridium compound is one of the indispensable components of the present invention because the photosensitive material is used is a high intensity of illumination.

Examples thereof are iridium(III) halide compounds, iridium(IV) halide compounds and iridium complex salts having a halogen, an amine, an oxalate etc., as a ligand, such as, for example, a hexachloroiridium(III) or (IV) complex salt, a hexamine iridium(III) or (IV) complex salt, a trioxalate iridium(III) or (IV) complex salt, etc. In this invention, an optional combination of the trivalent iridium complex salt and the tetravalent iridium complex salt can be used.

The iridium compound is as a solution in water or a proper solvent and for stabilizing the solution of the iridium compound, a method of adding an aqueous hydrogen halide solution (e.g., hydrochloric acid, hydrobromic acid and hydrofluoric acid) or an alkali halide (e.g., KCl, NaCl, KBr and NaBr) can be used generally as practiced. Also, in place of using a water-soluble iridium compound, other silver halide grains previously doped with iridium may be added to dissolve them at the preparation of silver halide grains.

The total addition amount of the iridium compound in this invention, is suitably from $1\times10^{-8}$ to $1\times10^{-5}$ mol, and preferably from $5\times10^{-8}$ to $5\times10^{-6}$ mole per mol of the silver halide finally formed.

The iridium compound can be added properly at the preparation of the silver halide emulsion or each step before coating the silver halide emulsion but in particular, it is preferred that the iridium compound is incorporated in silver halide grains at the formation of the grains.

Specific examples of the iridium compound are preferably halogen amines and oxalate complex salts such as iridium(III) chloride, iridium(III) bromide, iridium(IV) chloride, sodium hexachloroiridate(III), hexachloroiridium(III) salts, hexamine iridium(IV) salts, trioxalate iridium(III) salts, trioxalate iridium(IV) salts etc.

In this invention, it is preferred to further use an iron compound in the silver halide emulsion.

The iron compound which is preferably used in this invention is a compound containing divalent or trivalent iron ions and an iron salt and an iron complex salt each having a water solubility in the concentration range for use in this invention are preferred.

Specific examples thereof are ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albumate, ammonium ferric acetate, ferric bromide, ferric chloride, ferric chlorate, ferric citrate, ferric fluoride, ferric formate, ferric glycerophosphate, ferric hydroxide, ferric acid phosphate, ferric nitrate, ferric phosphate, ferric pyrophosphate, sodium ferric pyrophosphate, ferric thiocyanate, ferric sulfate, ammonium ferric sulfate, quanidine ferric sulfate, ammonium ferric citrate, potassium hexacyanoferrate(II), pentacyanoamine ferrous potassium, sodium ferric ethylenedinitrilotertacetate, potassium hexacyanoferrate(III), ferric tris(dipyridyl) chloride, pentacyanonitrosil ferric potassium and ferric hexaurea chloride.

In particular, hexacyanoferrates(II), hexacyanoferrates, ferrous thiocyanate and ferric thiocyanate are remarkably effective.

In the present invention, it is also preferred to use a compound selected from rhenium compounds, rhodium compounds, ruthenium compounds and osmium compounds in the silver halide emulsion.

As the rhenium compounds, rhodium compounds, ruthenium compounds and osmium compounds, the hexadentate complexes described in European Patent Publications (unexamined) 0336689A, 0336427A1, 0336425A1 and 0336426A1 are preferable and in particular, those having at least 41 cyanide ligands are preferred. In a preferred embodiment, the compounds can be shown by the following formula $$[M(CN)_{6-y}L_y]_n$$

wherein M represents rhenium, ruthenium or osmium; L represents a crosslinked ligand; y represents an integer of from 0 to 2; and n represents −2, −3 or −4.

Specific examples of the aforesaid compound are are illustrated below.

| | |
|---|---|
| $[Re(CN)_5]^{-4}$, | $[Ru(CN)_5]^{-4}$, |
| $[Os(CN)_5]^{-4}$, | $[ReF(CN)_5]^{-4}$, |
| $[RuF(CN)_5]^{-4}$, | $[OsF(CN)_5]^{-4}$, |
| $[ReCl(CN)_5]^{-4}$, | $[RuCl(CN)_5]^{-4}$, |
| $[OsCl(CN)_5]^{-4}$, | $[ReBr(CN)_5]^{-4}$, |
| $[RuBr(CN)_5]^{-4}$, | $[OsBr(CN)_5]^{-4}$, |
| $[ReI(CN)_5]^{-4}$, | $[RuI(CN)_5]^{-4}$, |
| $[OsI(CN)_5]^{-4}$, | $[ReF_2(CN)_4]^{-4}$, |
| $[RuF_2(CN)_4]^{-4}$, | $[OsFe_2(CN)_4]^{-4}$, |
| $[ReCl_2(CN)_4]^{-4}$, | $[RuCl_2(CN)_4]^{-4}$, |
| $[OsCl_2(CN)_4]^{-4}$, | $[RuBr_2(CN)_4]^{-4}$, |
| $[OsBr_2(CN)_4]^{-4}$, | $[ReBr_2(CN)_4]^{-4}$, |
| $[RuI_2(CN)_4]^{-4}$, | $[OsCl_2(CN)_5]^{-4}$, |
| $[Ru(CN)_5(OCN)]^{-4}$, | $[Os(CN)_5(OCN)]^{-4}$, |
| $[Ru(CN)_5(SCN)]^{-4}$, | $[Os(CN)_5(SCN)]^{-4}$, |
| $[Ru(CN)_5(N_3)]^{-4}$, | $[Os(CN)_5(N_3)]^{-4}$, |
| $[Ru(CN)_5(H_2O)]^{-3}$ and | $[Os(CN)_5(H_2O)]^{-3}$. |

It is preferably that the each of the above-described iron compounds, rhenium compounds, ruthenium compounds and osmium compounds is added during the formation of silver halide grains. The compound may be uniformly distributed in the silver halide grains or may be localized at the first step, intermediate step or last step of the formation of the silver halide grains but it is preferable that the compound is added at the last step of the formation of the silver halide grains, that is, after forming the grains at 50%, and more preferably 80% of the final grain size.

The addition amount of each compound is not more than $1\times10^{-3}$ mol, and preferably from $1\times10^{-6}$ to $1\times10^{-4}$ mol per mol of silver.

In this invention, other metal included in group VIII of the periodic table, such as cobalt, nickel, rhodium, palladium, platinum etc., can be used in the silver halide emulsion. In particular, by using a rhodium salt such as rhodium chloride, ammonium hexachlororhodiumate(III) etc., a silver halide emulsion having high contrast is obtained advantageously.

The silver halide emulsion for use in this invention usually is sensitized chemically. As a method of chemical sensitization, a sulfur sensitizing method, a reduction sensitizing method, a noble metal sensitizing method etc., can be used singly or as a combination thereof.

A typical noble metal sensitizing method is a gold sensitizing method and in the method a gold compound, such as mainly a gold complex salt is used. A complex salt of other noble metals than gold, such as platinum, palladium, iridium etc. may be used in place of a gold compound.

As a sulfur sensitizer for the sulfur sensitizing method, a sulfur compound contained in gelatin as well as other sulfur compounds such as thiosulfates, thioureas, thiazoles, rhodanines etc. can be used.

As a reduction sensitizer for the reduction sensitizing method, stannous salts, amines, formamidinesulfinic acid, silane compounds etc. can be used.

The light-sensitive silver halide emulsion for use in this invention may be sensitized spectrally by a sensitizing dye to blue light having a relatively long wavelength, green light, red light or infrared light.

As a sensitizing dye, cyanine dyes, merocyanine dyes, complex cyanine dyes, complex merocyanine dyes, holopolar cyanine dyes, styryl dyes, hemicyanine dyes, oxonol dyes, hemioxonol dyes etc. can be used.

The useful sensitizing dyes for use in this invention are described, e.g., in *Research Disclosure*, No. 17643, Item IV-A, page 23 (December, 1978), ibid., Item 1831X, page 437 (August, 1979) and the literature cited therein.

In particular, a sensitizing dye having a spectral sensitivity suitable for the spectral characteristics of each scanner light source can be selected advantageously.

For example, A) for an argon laser light source, simple merocyanines described in JP A-60-162247, JP-A-248653, U.S. Pat. No. 2,161,331, and West German Patent 936,0171 are selected advantageously, B) for a helium-neon laser light source, trinuclear cyan dyes described in JP-A-50-62425, JP-A-54-18726, and JP-A-59-102229 are selected advantageously, C) for an LED light source, thiacarbocyanines described in JP-B-48-42172, JP-B-51-9609, and JP-B-55-39818 (the term "JP-B" as used herein means an "examined published Japanese patent application" and JP-A-62-284343 are selected advantageously and D) for a semiconductor light source, tricarbocyanines described in JP-A-59-191032 and JP-A-60-80841 and dicarbocyanines having a 4-quinoline nucleus described in JP-A-59-192242 can be selected advantageously.

Specific examples of the sensitizing dyes are illustrated below:

Specific examples of A):

A-1

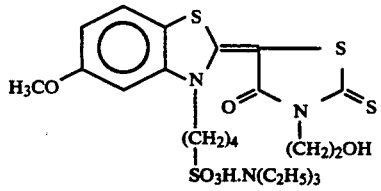

A-2

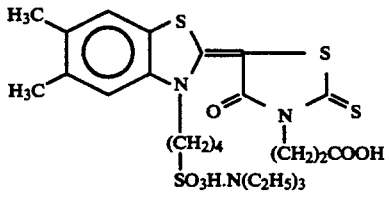

A-3

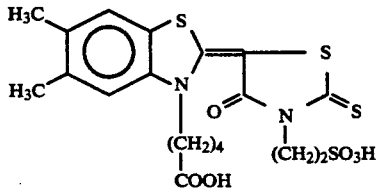

-continued

A-4

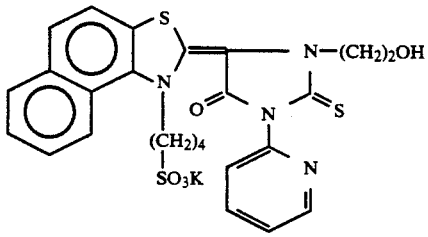

A-5

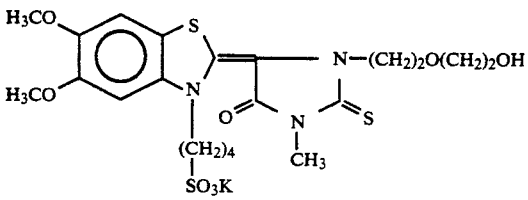

Specific examples of B):

B-1

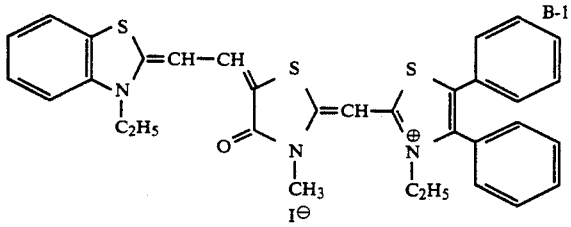

B-2

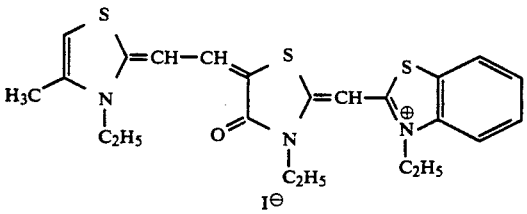

B-3

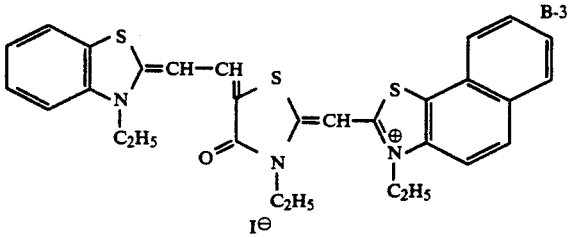

B-4

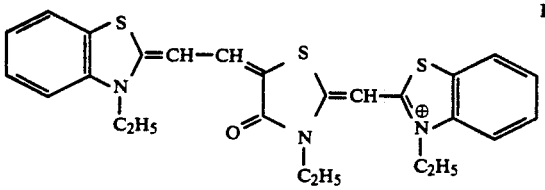

Specific examples of C):

The compounds represented by following formula (I): Formula (I):

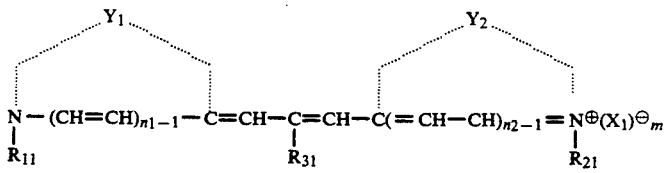

wherein $Y_1$ and $Y_2$ each represents a heterocyclic ring such as a non-metallic atomic group necessary for forming a benzithiazole ring, a benzoselenazole ring, a naphthothiazole ring, a naphthoselenazole ring or a quinoline ring, the heterocyclic rings each may be substituted by a lower alkyl group, an alkoxy group, a hydroxy group, an aryl group, an alkoxycarbonyl group or a halogen atom; $R_{11}$ and $R_{21}$ each represents a lower alkyl group, a sulfo group or an alkyl group having a carboxy group; $R_{31}$ represents a lower alkyl group; $X_1$ represents an anion; $n_1$ and $n_2$ each represents 1 or 2; and m represents 0 or 1, when m is 0, the compound of formula (I) forms an intramolecular salt.

Specific examples of the compound shown by formula (I) are shown below:

C-1

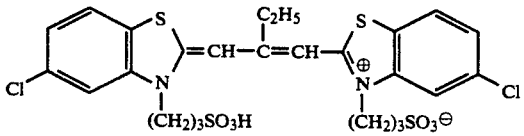

C-2

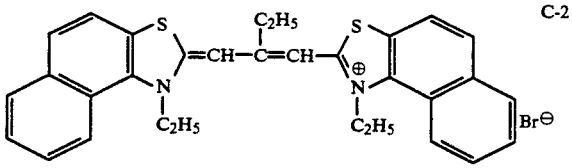

C-3

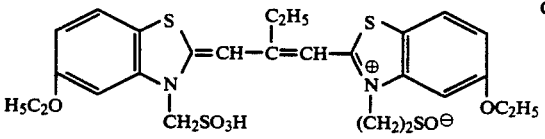

C-4

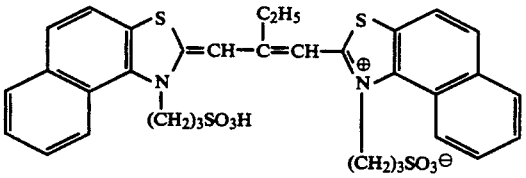

C-5

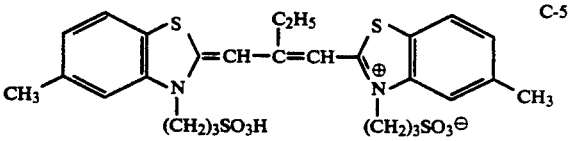

C-6

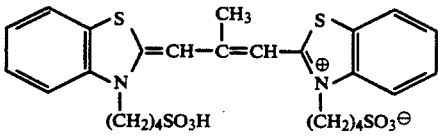

-continued

C-7

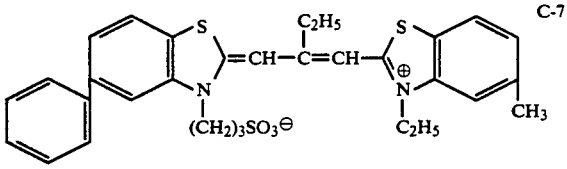

C-8

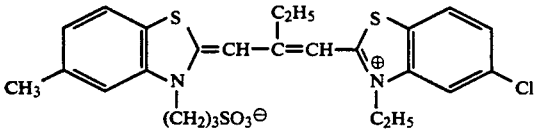

Specific Compound of D):

D-1

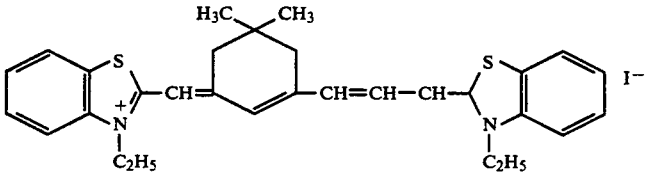

D-2

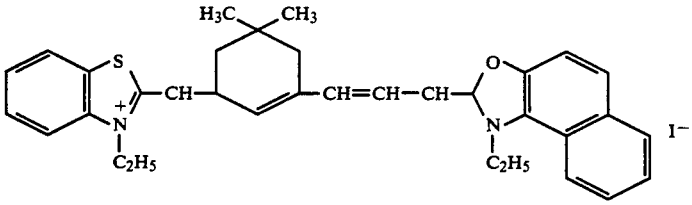

D-3

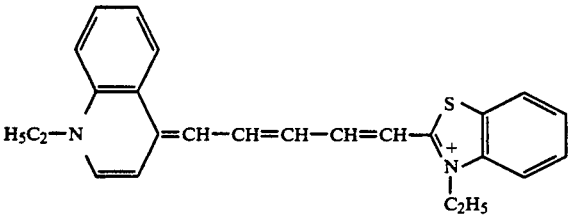

D-4

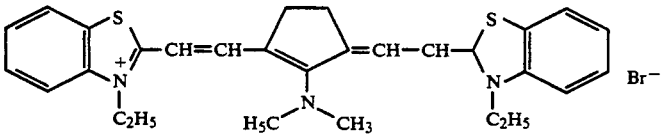

D-5

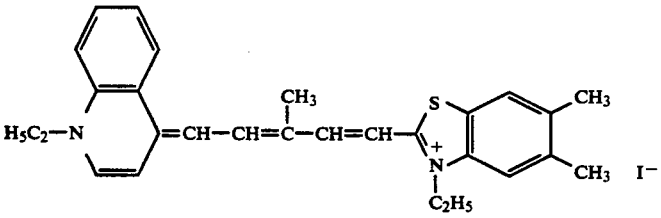

D-6

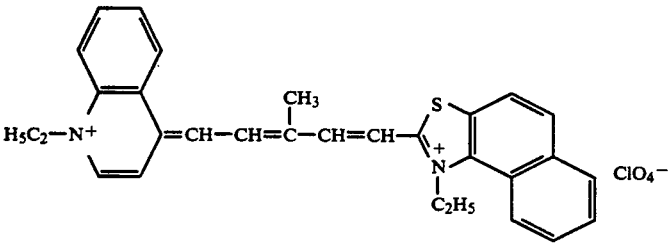

A combination with the sensitizing dye of C) described above is particularly preferable since a high sensitivity can be obtained.

The sensitizing dyes may be used singly or as a combination thereof and a combination of sensitizing dyes is used frequently for the purpose of super color sensitization. The sensitizing dyes are preferably used in an amount of from $10^{-7}$ mol to $10^{-2}$ mol per mol of silver halide, more preferably from $10^{-6}$ mol to $10^{-2}$ mol.

The silver halide emulsion may contain a dye which does not have a spectral sensitizing action by itself or a compound which does not absorb substantially visible light and shows a super color sensitization.

Useful sensitizing dyes, combinations of sensitizing dyes showing super color sensitization and compounds showing a super color sensitization are described in *Research Disclosure,* Vol, 176, No, 17643, page 23, IV-J (published, December 1978).

The silver halide photographic material of this invention can contain further various compounds for inhibiting the formation of fog during the production, storage and photographic processing of the photographic light-sensitive material or for stabilizing the photographic performance of the light-sensitive material.

Examples of the aforesaid compound are many compounds known as antifoggants or stabilizers, such as azoles (e.g., benzothiazolium salts, nitroindazoles, chlorobenzimidazoles, bromobenzimidazoles, mercaptothiazoles, mercaptobenzothiazoles, mercatothiazoles, aminotriazoles, benzothiazoles and nitrobenzotriazoles), mercaptopyrimidines, mercaptotriazines, thioketo compounds (e.g., oxazolinethione), azaindenes [e.g., triazaindenes, tetraazaindenes (in particular, 4-hydroxy-substituted (1,3,3a,7)tetraazaindenes) and pentaazaindenes], benzenethiosulfonic acid, benzenesulfinic acid, benzenesulfonic acid amide etc.

In particular, polyhydroxybenzene compounds are preferred from the point of improving the pressure resistance of the emulsion layer without reducing the sensitivity.

The polyhydroxybenzene compound for use in this invention is preferably the compound having the following structure;

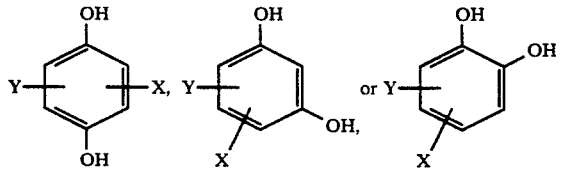

wherein X and Y each represents —H, —OH, a halogen —$OM_1$ (wherein $M_1$ represents an alkali metal ion), an alkyl group, a phenyl group, an amino group, a carbonyl group, a sulfo group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkyl ether group, an alkylphenyl group, an alkyl thioether group or a phenyl thioether group. Also, X and Y may be the same or different.

X and Y are preferably —H, —OH, —Cl, —Br, —COOH, —$CH_2CH_2COOH$, —$CH_3$, —$CH_2CH_3$, —$CH(CH_3)_2$, —$C(CH_3)_3$, —$OCH_3$, —CHO, —$SO_3Na$, —$SO_3H$, —$SCH_3$,

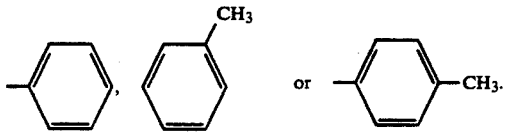

Specific examples of the particularly preferred polyhydroxybenzene compound for use in this invention are illustrated below;

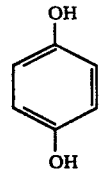

E-(1)

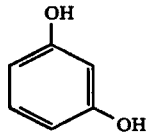

E-(2)

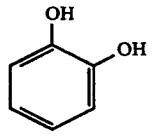

E-(3)

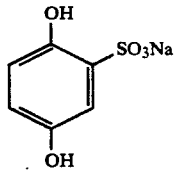

E-(4)

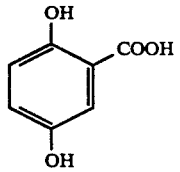

E-(5)

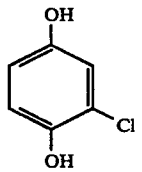

E-(6)

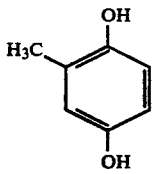

E-(7)

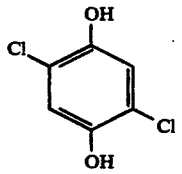

E-(8)

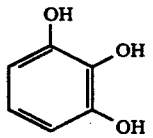

E-(9)

-continued

E-(10)

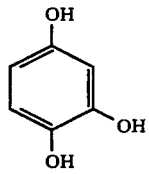

E-(11)

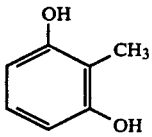

E-(12)

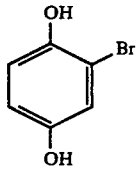

E-(13)

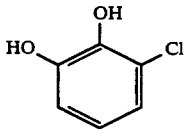

E-(14)

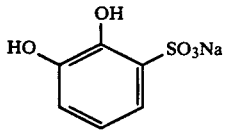

E-(15)

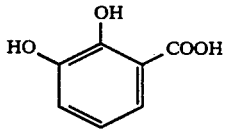

E-(16)

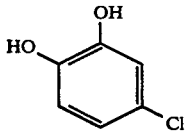

E-(17)

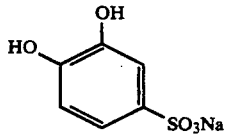

E-(18)

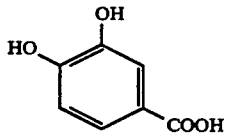

E-(19)

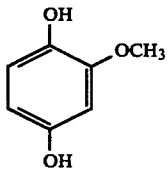

-continued

E-(20)

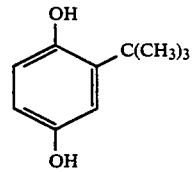

E-(21)

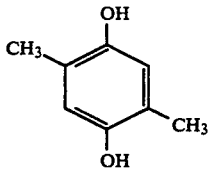

E-(22)

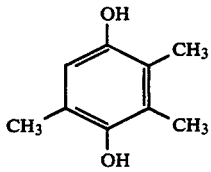

The polyhydroxybenzene compound may be incorporated in the silver halide emulsion layer of the photographic light-sensitive material or other layer than the emulsion layer. The addition amount thereof is effectively in the range of $1\times10^{-5}$ to 1 mol, and is particularly effectively in the range of $1\times10^{-3}$ to $1\times10^{-1}$ mol per mol of silver.

The silver halide photographic material of this invention may contain in the hydrophilic colloid layer a water-soluble dye to serve as a filter dye, an irradiation inhibition or for other various purposes. The hydrophilic colloid layer may be prepared by adding required ingredients into an aqueous hydrophilic colloidal solution, may be coated on the support at the same time as coating other layers, and may be controlled in a humidity environment followed by drying to form photographic material having required layer constitutions. Such a dye includes oxonol dyes, hemioxonol dyes, styryl dyes, merocyanine dyes, cyanine dyes and azo dyes. In these dyes, oxonol dyes, hemioxonol dyes and merocyanine dyes are useful.

The silver halide photographic emulsion layers of the photographic light-sensitive material of the present invention may further contain a developing agent such as a polyalkylene oxide or the ether derivatives, ester derivatives and amine derivatives thereof, thioether compounds, thiomorpholines, quaternary ammonium salt compounds, urethane derivatives, urea derivatives, imidazole derivatives, 3-pyrazolidones, aminophenols etc., for the purposes of increasing sensitivity, increasing contrast or accelerating development.

In these developing agents, 3-pyrazolidones (e.g., 1-phenyl-3-pyrazolidone and 1-phenyl-4-methyl-4-hydroxymethyl-3-pyrazolidone) are preferred and the amount thereof is usually less than 5 g/m$^2$ and preferably from 0.01 g/m$^2$ to 0.2 g/m$^2$.

The photographic silver halide emulsions and the light-insensitive hydrophilic colloids for use in this invention may contain an inorganic or organic hardening agent.

Examples of the hardening agent are active vinyl compounds such as 1,3,5-triacryloyl-hexahydro-S-triazine, bis(vinylsulfonyl) methyl ether, N,N-methylene-bis[ $\beta$-(vinylsulfonyl)propionamide] etc.; active halogen compounds such as 2,4-dichloro-6-hydroxy-s-triazine etc.; mucohalogenic acids such as mucochloric acid etc.; N-carbamoylpyridinium salts such as (1-morpholino)carbonyl-3-pyridinio) methanesulfonate etc.; and haloamidinium salts such as 1-chloro-1-pyridinomethylene)pyrolidinium and 2-naphthalene sulfonate. They can be used singly or as a combination there of.

In the compounds, the active vinyl compounds described in JP-A-53-41220, JP-A-53-57257, JP-A-59-162546, and JP-A-60-80846 and the active halogenated compounds described in U.S. Pat. No. 3,325,287 are preferred.

The photographic silver halide emulsion layers and the hydrophilic colloid layers of the photographic light sensitive material of the present invention may further contain various surface active agents for the purposes of a coating aid, static inhibition, the improvement of slidability, the improvement of emulsified dispersion, a sticking prevention and the improvement of photographic properties (e.g., a development acceleration, the increase of contrast and the increase of sensitivity).

Examples of the surface active agent are nonionic surface active agents such as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyalkylene glycol alkylamines, polyalkylene glycol alkylamides and polyethylene oxide addition products of silicone), glycidol derivatives (e.g., alkenylsuccinic acid polyglyceride and alkylphenyl polyglyceride), fatty acid esters of polyhydric alcohols, alkyl esters of saccharose etc.; anionic surface active agents containing an acid group (e.g., a carboxy group, a sulfo group, a phospho group, a sulfuric acid ester group and phosphoric acid ester group), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters etc.; amphoteric surface active agents such as amino acids, aminoalkylsulfonic acids, aminoalkylsulfuric acid esters, aminoalkylphosphoric acid esters, alkylbetaines, amine oxides etc.; and cationic surface active agents such as alkylamine salts, aliphatic or aromatic quaternary ammonium salts, heterocyclic quaternary ammonium salts (such as pyridinium, imidazolium, etc.), phosphonium or sulfonium salts containing aliphatic or heterocyclic ring etc.

Also, for static inhibition, the fluorine-containing surface active agents described in JP-A-60-80849 are used preferably.

The silver halide photographic emulsion layers and other hydrophilic colloid layers of the photographic light-sensitive material of the present invention can further contain a matting agent such as silica, magnesium oxide, polymethylmethacrylate etc., which can be used for the purpose of sticking prevention.

The photographic light-sensitive material of the present invention can contain a dispersion of a water insoluble or water sparingly soluble synthetic polymer for improving the dimensional stability. For example, polymers of an alkyl(meth)acrylate, an alkoxyacryl(meth)acrylate, a glycidyl(meth)acrylate etc., singly or as a combination thereof, or polymers of the above-described monomer and other monomer such as acrylic acid, methacrylic acid etc., can be used.

As a binder or a protective colloid for the photographic silver halide emulsions for use in this invention, gelatin is used advantageously but other hydrophilic colloids can be used.

Examples of the hydrophilic colloid are proteins such as gelatin derivatives, graft polymers of gelatin and other polymers, albumin, casein etc.; cellulose derivatives such as hydroxyethyl cellulose, carboxymethyl cellulose, cellulose sulfuric acid esters etc.; saccharose derivatives such as sodium alginate, starch derviatives etc.; and various synthetic hydrophilic polymers (homopolymers or copolymers) such as polyvinyl alcohol, polyvinyl alcohol partial acetal, poly-N-vinylpyrrolidone, polyacrylic acid, polymethacrylic acid, polyacrylamide, polyvinyl imidazole, polyvinylpyrazole etc.

As gelatin, limed gelatin and acid-treated gelatin can be used and further gelatin hydrolyzed products and gelatin enzyme decomposed products can be used.

Also, the silver halide emulsion layers for use in this invention can further contain a polymer latex such as an alkylacrylate latex.

As the support of the photographic light-sensitive material of the present invention, cellulose acetate films, cellulose diacetate films, nitrocellulose films, polystyrene films, polyethylene terephthalate films, baryta-coated papers, polyolefin-coated papers etc., can be used.

There is no particular restriction on the developing agent for a developer which is used for developing the photographic light-sensitive material of this invention but it is preferred that the developer contains a dihydrobenzene in the point of easily obtaining good dot images. Also, as the case may be a combination of a dihydroxybenzene and 1-phenyl-3-pyrazolone or a combination of a dihydroxybenzene and a p-aminophenol is used.

As the dihydroxybenzene developing agent which is used in this invention, there are hydroquinone, chlorohydroquinone, bromohydroquinone, isopropylhydroquinone, 2,3-dichlorohydroquinone, 2,5-dichlorohydroquinone, 2,3-dibromohydroquinone and 2,5-dimethylhydroquinone, but hydroquione is particularly preferred.

As 1-phenyl-3-pyrazolidone and the derivatives thereof which can be used as the developing agent in this invention, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrzolidone, etc.

As the p-aminophenol series developing agent for use in this invention, there are N-methyl-p-aminophenol, p-aminophenol, N-(β-hydroxyethyl)-p-aminophenol, N-(4-hydroxyphenyl)glycine, 2-methyl-p-aminophenol, p-benzylaminophenol etc., but of the compounds, N-methyl-p-aminophenol is preferred.

The developing agent is preferably used from 0.05 mol/liter to 0.8 mol/liter. Also, in the case of using the combination of a dihydroxybenzene and a 1-phenyl-3-pyrazolidone or p-aminophenol, it is preferred that the former is used in an amount of from 0.05 mol/liter to 0.5 mol/liter and the latter is used in an amount of not more than 0.06 mol/liter.

In this invention, a sulfite is used as a preservative and as the preservative, there are sodium sulfite, potassium sulfite, lithium sulfite, ammonium sulfite, sodium hydrogensulfite, potassium metahydrogensulfite, formaldehyde sodium hydrogensulfite etc.

The amount of the sulfite is preferably at least 0.3 mol/liter and preferably at least 0.4 mol/liter. Also, the upper limit of the sulfite is preferably 2.5 mol/liter and particularly 1.2 mol/liter.

For controlling pH of the developer, an alkali is used and the alkali includes a pH controlling agent or a buffer such as sodium hydroxide, potassium hydroxide, sodium carbonate, potassium carbonate, sodium tertiary phosphate, potassium tertiary phosphate, sodium silicate, potassium silicate etc.

The developer for use in this invention may further contain other additive including a development inhibitor such as boric acid, borax, sodium bromide, potassium bromide and potassium iodide; an organic solvent such as ethylene glycol, diethylene glycol, triethylene glycol, dimethylformamide, methylcellosolve, hexylene glycol, ethanol, methanol etc.; and an antifoggant, e.g., a mercapto series compound such as 1-phenyl-5-mercaptotetrazole, sodium 2-mercaptobenzimidazole-5-sulfonate etc., an indazole series compound such as 5-nitroindazole etc., and a benztriazole series compound such as 5-methylbenzotriazole etc.

Furthermore, if necessary, the developer may further contain a toning agent, a surface active agent, a defoaming agent, a water softener, a hardening agent etc.

In particular, the amino compounds described in JP-A-56-106244 and the imidazole compounds described in JP-B-48-35493 are preferred in the point of accelerating the development or increasing the sensitivity.

For the developer being used in this invention, the compounds described in JP-A-62-212651 can be used as an uneven development inhibitor and also the compounds described in JP-A-61-267759 can be used as an dissolution aid.

A fix solution which is used after development is an aqueous solution containing a fixing agent and, if necessary, a hardening agent (e.g., a water-soluble aluminum compound), acetic acid and a dibasic acid (e.g, tartaric acid, citric acid or the salts thereof) and having a pH of preferably 3.8 or lower, and more preferably from 4.0 to 5.5.

As a fixing agent, there are sodium thiosulfate, ammonium thiosulfate etc., but ammonium thiosulfate is preferred particularly in the point of the fixing rate. The amount of the fixing agent can be properly changed but is generally from about 0.1 mol/liter to about 5 mols/-liter.

The water-soluble aluminum salt which is used mainly as a hardening agent in a fix solution is a compound which is known generally as a hardening agent for an an acidic hardening fix solution and examples thereof are aluminum chloride, aluminum sulfate, potassium alum etc.

As the above-described dibasic acid, tartaric acid or the derivatives thereof and citric acid or the derivatives thereof can be used singly or as a mixture thereof.

The effective amount of the dibasic acid is at least 0.005 mol, and particularly from 0.01 mol/liter to 0.03 mol/liter per liter of the fix solution.

Typical examples of the dibasic acid are tartaric acid, potassium tartarate, sodium tartarate, potassium sodium tartarate, ammonium tartarate, ammonium potassium tartarate etc.

Examples of citric acid and the derivatives thereof which are used effectively in this invention are citric acid, sodium citrate, potassium citrate etc.

The fix solution can, if necessary, contain a preservative (e.g., sulfites and hydrogensulfites), a pH buffer (e.g., acetic acid and boric acid), a pH controlling agent (e.g., ammonia and sulfate), an image storage stability improving agent (e.g., potassium iodide) and a chelating agent. In this case, the amount of the pH buffer is used in an amount of from 10 g/liter to 40 g/liter and preferably from about 18 g/liter to about 25 g/liter because the pH of the developer is high.

The photographic light-sensitive material of the present invention shows an excellent performance in quick processing by an automatic processor wherein the total processing time is from 15 seconds to 60 seconds.

In quick processing in this invention, the temperature and the time for the development and fixing are from about 25° C. to 50° C. for 25 seconds or shorter and are preferably from 30° C. to 40° C. and for from 4 seconds to 15 seconds.

In this invention, the photographic light-sensitive material is, after development and fixing, washed with water or stabilized. In this case, in the wash step, by employing a countercurrent washing system of from 2 to 3 stages, the amount of water can be saved. Also, when the light-sensitive material is washed with a small amount of wash water, it is preferred to employ a squeeze roller-equipped wash bath. Furthermore, a part or the whole of the overflow liquid from the wash bath or the stabilization bath can be utilized for the fix solution as described in JP-A-60-235133. Thus, the amount of the wast solution can be reduced.

Also, wash water may contain an antifoggant (e.g., the compounds described in Horiguchi, *Bokin Bobai no Kagaku* (*Antibacterial and Antifungal Chemistry*) and a chelating agent.

The temperature and the time for the wash step by the above-described method and the stabilization bath are from 0° C. to 50° C. for about 5 seconds to 30 seconds, and preferably from 15° C. to 40° C. for about 4 seconds to 20 seconds.

The photographic light-sensitive material thus developed, fixed, and washed or stabilized in this invention is dried through squeeze rollers. Drying is carried out at from 40° C. to 80° C. for from 4 seconds to 30 seconds.

The total processing time in this invention is the total time required for the leading edge of the film from its entering the inlet of an automatic processor to emerging from the outlet of the drying section through the developing bath, a transporting portion, the fix bath, a transporting portion, the wash bath (or stabilization bath), a transporting portion and the drying portion.

The photographic material of the present invention may be processed in the automatic processor at a line speed of 1000 m/min or higher.

The invention is described practically by the following examples but the invention is not limited to them.

EXAMPLE 1

(I) "Preparation of Emulsion"

Emulsion A

Solution 1

-continued

| | |
|---|---|
| Water | 1.0 liter |
| Gelatin | 20 g |
| Sodium Chloride | 20 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 43.5 g |
| Potassium Bromide | 14 g |
| Potassium Hexachloroiridate(III) | 0.018 mg |

To solution 1 kept at 38° C. and pH 4.5, were added simultaneously solution 2 and solution 3 with stirring over a period of 10 minutes to form nucleus grains having a mean grain size of 0.16 μm.

Then, solution 4 and solution 5 described below were added thereto over a period of 10 minutes. Furthermore, 0.15 g of potassium iodide was added to finish the grain formation.

| | |
|---|---|
| Solution 4 | |
| Water | 400 ml |
| Silver Nitrate | 100 g |
| Solution 5 | |
| Water | 400 ml |
| Sodium Chloride | 43.5 g |
| Potassium Bromide | 14 g |

Thereafter, the emulsion was washed with water by a flocculation method according to an ordinary manner and gelatin was added to the emulsion. Then, after adjusting pH and pAg thereof to 5.1 and 7.5, respectively, and adding thereto 8 mg of sodium thiosulfate and 12 mg of chloroauric acid, a chemical sensitization was applied at 65° C. for obtaining the optimum sensitization, and then 200 mg of 1,3,3a,7-tetraazindene as a stabilizer and phenoxy ethanol as antiseptic were added to the emulsion. Finally, a cubic grain silver iodochlorobromide emulsion containing 80 mol % silver chloride and a mean grain size of 0.20 μm (the coefficient of variation 9%) was obtained.

Emulsion B

By following the same procedure for preparing Emulsion A except that the amount of potassium hexachloroiridate(III) being added to solution 3 was changed to 0.184 mg, a cubic grain silver iodochlorobromide emulsion containing 80 mol % silver chloride and having a mean grain size of 0.20 μm (the coefficient of variation 9%) was obtained.

Emulsion C

By following the same procedure for preparing Emulsion A except that the amount of potassium hexachloroiridate (III) being added to solution 3 was changed to 18.4 mg, a cubic grain silver iodochlorobromide emulsion containing 80 mol % silver chloride and having a mean grain size of 0.20 μm (the coefficient of variation 9%) was obtained.

Emulsion D

In the above-described method for preparing Emulsion A, solution 3 and solution 5 were changed as follows.

| | |
|---|---|
| Solution 3 | |
| Water | 400 ml |
| Sodium Chloride | 36.6 g |
| Potassium Bromide | 28 g |
| Potassium Hexachloroiridate(III) | 0.018 mg |
| Solution 5 | |
| Water | 400 ml |
| Sodium Chloride | 36.6 g |
| Potassium Bromide | 28 g |

By following the same procedure for preparing Emulsion A except that solution 3 and solution 5 described above were used, a cubic grain silver iodochlorobromide emulsion containing 60 mol % silver chloride and having a mean grain size of 0.20 μm (the coefficient of variation 9%) was obtained.

Emulsion E

By following the same procedure for preparing Emulsion E except that the amount of potassium hexachloroiridate(III) being added to solution 3 was changed to 0.184 mg, a cubic grain silver iodochlorobromide emulsion containing 60% silver chloride and having a mean grain size of 0.20 μm (the coefficient of variation 9%) was obtained.

Emulsion F

By following the same procedure for preparing Emulsion E except that the amount of potassium hexachloroiridate(III) being added to solution 3 was changed to 18.4 mg, a cubic grain silver iodochlorobromide containing 60% silver chloride and having a mean grain size of 0.20 μm (the coefficient of variation 9%) was obtained.

Emulsion G

By following the same procedure for preparing Emulsion E except that potassium hexachloroiridate(III) was not added to solution 3, a cubic grain silver iodochlorobromide emulsion containing 60% silver chloride and having a mean grain size of 0.20 μm (the coefficient of variation 9%) was obtained.

Emulsion H

In the above-described method for preparing Emulsion A, solution 3 and solution 5 were changed as follows.

| | |
|---|---|
| Solution 3 | |
| Water | 400 ml |
| Sodium Chloride | 29.7 g |
| Potassium Bromide | 42 g |
| Potassium Hexachloroiridate(III) | 0.018 mg |
| Solution 5 | |
| Water | 400 ml |
| Sodium Chloride | 29.7 g |
| Potassium Bromide | 42 g |

By following the same procedure for preparing Emulsion A except that solution 3 and solution 5 described above were used, a cubic grain silver iodochlorobromide emulsion containing 40 mol % having a mean grain size of 0.20 μm (the coefficient of variation 9) was obtained.

Emulsion I

By following the same procedure for preparing Emulsion H except that the amount of potassium hexachloroiridate(III) being added to solution 3 was changed to 0.184 mg, a cubic grain silver iodochlorobromide emulsion containing 40% silver chloride and having a mean grain size of 0.20 μm (the coefficient of variation 9%) was obtained.

Emulsion J

By following the same procedure for preparing Emulsion I except that the amount of potassium hexachloroiridate(III) being added to solution 3 was changed to 18.4 mg, a cubic grain silver iodo chlorobromide emulsion containing 40 mol % silver chloride and having a mean grain size of 0.20 μm (the coefficient of variation) was obtained.

Emulsion K

In the above-described method of preparing Emulsion A, solution 3 and solution 5 were changed as follows.

| | |
|---|---|
| Solution 3 | |
| Water | 400 ml |
| Sodium Chloride | 9 g |
| Potassium Bromide | 56 g |
| Potassium Hexachloroiridate(III) | 0.018 mg |
| Solution 5 | |
| Water | 400 ml |
| Sodium Chloride | 9 g |
| Potassium Bromide | 56 g |

By following the same procedure for preparing Emulsion A except that solution 3 and solution 5 described above were used and when adding solution 2 and solution 3 and also of adding solution 4 and solution 5, pAg was controlled at 7.5, a cubic grain silver iodochlorobromide emulsion containing 20 mol % silver chloride and having a mean grain size of 0.20 μm (the coefficient of variation 9%) was obtained.

Emulsion L

By following the same procedure for preparing Emulsion K except that the amount of potassium hexachloroiridate(III) being added to solution 3 was changed to 0.184 mg, a cubic grain silver iodochlorobromide emulsion containing 20 mol % silver chloride and having a mean grain size of 0.20 μm (the coefficient of variation 9%) was obtained.

Emulsion M

By following the same procedure for preparing Emulsion K except that the amount of potassium hexacholoroiridate(III) being added to solution 3 was changed to 18.4 mg, a cubic grain silver iodochlorobromide emulsion containing 20 mol % silver chloride and having a mean grain size of 0.20 μm (the coefficient of variation 9%) was obtained.

Emulsion N

By following the same procedure for preparing Emulsion M except that potassium hexachloroiridate(III) was not added to solution 3, a cubic grain silver iodochlorobromide emulsion containing 20 mol % silver chloride and having a mean grain size of 0.20 μm (the coefficient of variation 9%) was obtained.

(2) "Preparation of Coated Samples"

To each of Emulsions A, C, D, E, G, H, K, and M was applied an infrared sensitization by adding 30 mg/mol-Ag of an infrared sensitizing dye D-5. Furthermore, for the super color sensitization and the stabilization, disodium 4,4'-bis(4,6-dinaphthoxypyrimidin-2-ylamino)stilbenzylsulfonate and 2,5-dimethyl-3-allylbenzothiazole iodide were added thereto in the amounts of 300 mg and 450 mg, respectively to mol of silver.

Furthermore, after adding 100 mg/m$^2$ of hydroquinone, a polyethylacrylate latex in an amount of 25% of the gelatin binder and 86 mg/m$^2$ of 2-bis(vinylsulfonylamino)ethane as a hardening agent were added to each emulsion and after further adding thereto gelatin, the emulsion was coated on a polyester film support at the gelatin coverage and the silver coverage as shown in Table 1 below to provide coated samples 1 to 36. In this case, a coating composition containing 0.5 g/m$^2$ of gelatin, 20 mg/m$^2$ of a dye having the structural formula (2) shown below, 60 mg/m$^2$ of polymethylmethacrylate having a mean particle size of 2.5 μm and 70 mg/m$^2$ of colloidal silica having a mean particle size of 10 μm as matting agents, and sodium dodecylsulfonate and a fluorine-containing surface active agent having formula (1) shown below as coating aids were simultaneously coated on the emulsion layer as a protective layer.

$$C_8F_{17}SO_2N(C_3H_7)-CH_2COOK \quad (1)$$

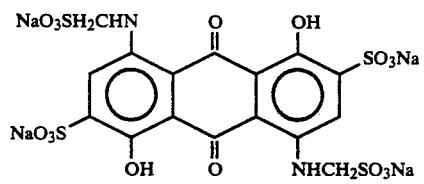

(2)

In addition, the amount of gelatin described in Table 1 below shows the sum of 0.5 g/m$^2$ of gelatin in the protective layer and in the emulsion layer.

Furthermore, the support of each sample in the example has a back layer and a back protective layer having the compositions shown below.

| | |
|---|---|
| (Back Layer) | |
| Gelatin | 2.0 g/m$^2$ |
| Sodium Dodecylbenzenesulfonate | 80 mg/m$^2$ |
| Dye (3) | 70 mg/m$^2$ |
| Dye (4) | 85 mg/m$^2$ |
| Dye (5) | 90 mg/m$^2$ |
| 1,3-Divinylsulfone-2-propanol | 60 mg/m$^2$ |
| [Back Protective Layer] | |
| Gelatin | 0.5 g/m$^2$ |
| Polymethylmethacrylate (grain size: 4.7 μm) | 30 mg/m$^2$ |
| Sodium dedecylbenzenesulfonate | 20 mg/m$^2$ |
| Fluorine-containing Surface active agent [aforesaid (1)] | 2 mg/m$^2$ |
| Silicone Oil | 100 mg/m$^2$ |

Dye (3):

-continued

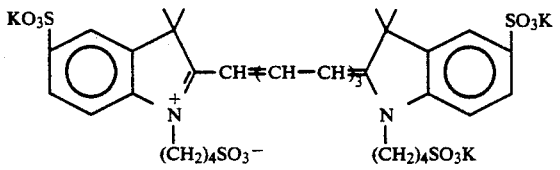

Dye (4):

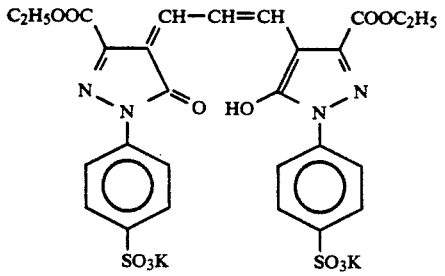

Dye (5):

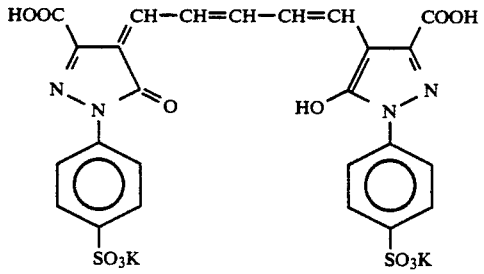

(3) "Evaluation of Samples"

Evaluation of Photographic Performance

Each sample was exposed with a xenon flash light having a light emitting time of $10^{-6}$ second through an interference filter having a peak at 780 n.m. and a continuous wedge and then subjected to a sensitometry at the temperature and time shown below using an automatic processor FG-710NH (trade name, made by Fuji Photo Film Co., Ltd.).

Developer (a) and fix solution (a) shown below were used as the developer and fix solution, respectively.

| | | |
|---|---|---|
| Development | 38° C. | 14 sec. |
| Fix | 37° C. | 9.7 sec. |
| Wash | 26° C. | 9 sec. |
| Squeeze | | 2.4 sec. |
| Drying | 55° C. | 8.3 sec. |
| Total | | 43.4 sec |

The logarithm of the exposure amount giving a density of 3.0 was defined as the sensitivity and is shown in Table 1 as a relative sensitivity (the sensitivity of Sample No. 11 was defined as 100). Also, the inclination of the line passing through the point of density 0.1 and the point of density 3.0 in the characteristic curve was defined as gradation and shown in Table 1.

Evaluation of Processing Reliance

Each sample having a size of 10 inch×12 inch was exposed such that the blackened ratio became 50%, and after continuously processing 600 sample sheets with the developer and the fix solution without replenishing, the samples were processed by the same manner as described above. The sensitivity was shown by the logarithm of the exposure amount giving density 3.0 and the difference between the exposure amount thereof and the exposure amount using fresh processing solutions was measured. (ΔlogE).

The results are shown in Table 1 as the processing reliance.

In addition, the allowable level of the processing reliance (ΔlogE) was within 0.03.

Evaluation of Remaining Color

In the above-described processing conditions, the washing temperature was changed to 5° C. and the remaining color was evaluated by the extent of color by dyes remaining in each sample processed. In the table, the evaluation is shown ⊙, ○, Δ, ×, and ××, wherein ⊙ and ○ are allowable level and Δ, ×, and ×× are unallowable level.

| | |
|---|---|
| **Developer (a):** | |
| Hydroquinone | 25.0 g |
| 4-Methyl-4-hydroxymethyl-1-phenyl-3-pyrazolidone | 0.5 g |
| Potassium Sulfite | 90.0 g |
| Ethylenediaminetetraacetic Acid Disodium | 2.0 g |
| Potassium Bromide | 5.0 g |
| 5-Methylbenzotriazole | 0.2 g |
| 2-Mercaptobenzimidazole-5-sulfonic Acid | 0.3 g |
| Sodium Carbonate | 20 g |
| Water to make | 1 liter |
| (pH adjusted to 10.6 with sodium hydroxide) | |
| **Fix Solution (a):** | |
| Ammonium Thiosulfate | 210 g |
| Sodium Sulfite (Anhydrous) | 20 g |
| Ethylenediaminetetraacetic Acid Disodium | 0.1 g |
| Glacial Acetic Acid | 15 g |
| Water to make | 1 liter |
| (pH adjusted to 4.8 with aqueous ammonia) | |
| **Wash Water:** | |
| City Water | |

TABLE 1

| Sample No. | Coated Amount of Gelatin (g/m²) | Coated Amount of Ag (g/m²) | Halogen Composition | Iridium Content (mol/mol Ag) | Sensitivity | Gradation | Processing Reliance (ΔlogE) | Remaining Color | Note |
|---|---|---|---|---|---|---|---|---|---|
| 1 | 1.0 | 2.5 | $AgBrCl_{20}$ | $3 \times 10^{-8}$ | 80 | 5.0 | 0.06 | Δ | Comparison |
| 2 | " | " | " | $3 \times 10^{-5}$ | 60 | 4.0 | 0.08 | Δ | " |
| 3 | " | " | $AgBrCl_{80}$ | $3 \times 10^{-8}$ | 105 | 7.0 | 0.02 | ⊙ | Invention |
| 4 | " | " | " | $3 \times 10^{-5}$ | 80 | 4.0 | 0.03 | ⊙ | Comparison |
| 5 | " | 3.5 | $AgBrCl_{20}$ | $3 \times 10^{-8}$ | 80 | 5.0 | 0.08 | X | " |
| 6 | " | " | " | $3 \times 10^{-5}$ | 60 | 4.5 | 0.09 | X | " |
| 7 | " | " | $AgBrCl_{80}$ | $3 \times 10^{-8}$ | 105 | 6.5 | 0.05 | Δ | " |
| 8 | " | " | " | $3 \times 10^{-5}$ | 80 | 4.0 | 0.05 | Δ | " |
| 9 | 2.0 | 2.5 | $AgBrCl_{20}$ | $3 \times 10^{-8}$ | 80 | 4.0 | 0.07 | Δ | " |

TABLE 1-continued

| Sample No. | Coated Amount of Gelatin ($g/m^2$) | Coated Amount of Ag ($g/m^2$) | Halogen Composition | Iridium Content (mol/mol Ag) | Sensitivity | Gradation | Processing Reliance (ΔlogE) | Remaining Color | Note |
|---|---|---|---|---|---|---|---|---|---|
| 10 | " | " | " | $3 \times 10^{-5}$ | 70 | 4.5 | 0.09 | Δ | " |
| 11 | " | " | $AgBrCl_{80}$ | $3 \times 10^{-8}$ | 100 | 6.5 | 0.02 | ◎ | Invention |
| 12 | " | " | " | $3 \times 10^{-5}$ | 70 | 4.5 | 0.04 | ◎ | Comparison |
| 13 | " | 3.5 | $AgBrCl_{20}$ | $3 \times 10^{-8}$ | 75 | 4.5 | 0.08 | X | " |
| 14 | " | " | " | $3 \times 10^{-5}$ | 65 | 5.0 | 0.09 | X | " |
| 15 | " | " | $AgBrCl_{80}$ | $3 \times 10^{-8}$ | 100 | 6.5 | 0.06 | Δ | " |
| 16 | 2.0 | 3.5 | $AgBrCl_{80}$ | $3 \times 10^{-5}$ | 70 | 5.0 | 0.07 | Δ | Comparison |
| 17 | 2.5 | 2.5 | $AgBrCl_{20}$ | $3 \times 10^{-8}$ | 80 | 4.0 | 0.07 | X | " |
| 18 | " | " | " | $3 \times 10^{-5}$ | 70 | 4.0 | 0.08 | X | " |
| 19 | " | " | $AgBrCl_{80}$ | $3 \times 10^{-8}$ | 100 | 6.5 | 0.02 | ○ | Invention |
| 20 | " | " | " | $3 \times 10^{-5}$ | 80 | 5.5 | 0.04 | ○ | Comparison |
| 21 | " | 3.5 | $AgBrCl_{20}$ | $3 \times 10^{-8}$ | 70 | 4.5 | 0.09 | XX | " |
| 22 | " | " | " | $3 \times 10^{-5}$ | 80 | 4.0 | 0.10 | XX | " |
| 23 | " | " | $AgBrCl_{80}$ | $3 \times 10^{-8}$ | 95 | 6.5 | 0.07 | X | " |
| 24 | " | " | " | $3 \times 10^{-5}$ | 80 | 5.0 | 0.08 | X | " |
| 25 | 3.0 | 2.5 | $AgBrCl_{20}$ | $3 \times 10^{-8}$ | 60 | 4.5 | 0.09 | X | " |
| 26 | " | " | " | $3 \times 10^{-5}$ | 70 | 4.0 | 0.10 | X | " |
| 27 | " | " | $AgBrCl_{80}$ | $3 \times 10^{-8}$ | 90 | 5.5 | 0.05 | Δ | " |
| 28 | " | " | " | $3 \times 10^{-5}$ | 70 | 4.0 | 0.06 | Δ | " |
| 29 | " | 3.5 | $AgBrCl_{20}$ | $3 \times 10^{-8}$ | 80 | 4.0 | 0.15 | XX | " |
| 30 | " | " | " | $3 \times 10^{-5}$ | 70 | 4.5 | 0.14 | XX | " |
| 31 | 3.0 | 3.5 | $AgBrCl_{80}$ | $3 \times 10^{-8}$ | 95 | 5.5 | 0.08 | X | Comparison |
| 32 | " | " | " | $3 \times 10^{-5}$ | 70 | 3.5 | 0.07 | X | " |
| 33 | 2.0 | 2.5 | $AgBrCl_{40}$ | $3 \times 10^{-8}$ | 105 | 7.0 | 0.02 | ◎ | Invention |
| 34 | " | " | $AgBrCl_{60}$ | $3 \times 10^{-8}$ | 100 | 6.5 | 0.01 | ◎ | " |
| 35 | " | " | " | $3 \times 10^{-7}$ | 105 | 7.0 | 0.01 | ◎ | " |
| 36 | " | " | " | — | 70 | 4.0 | 0.08 | ◎ | Comparison |

*Containing 0.1/mol Ag of silver bromide

As is clear from the results of Table 1, for obtaining a high sensitivity, showing a good processing reliance and keeping the remaining color at an allowable level, it is necessary that the coating amount of gelatin, the coating amount of silver, the coating amount of silver chloride and the content of iridium are above definite amounts.

EXAMPLE 2

(1) "Preparation of Emulsions"

By following the same procedure for preparing Emulsion A in Example 1 except that the compound of iron, ruthenium, osmium, rhenium, or rhodium in the amount shown in Table 2 below was added in solution 5, a cubic grain silver iodochlorobromide emulsion containing 80 mol % silver chloride and having a mean grain size of 0.20 μm was obtained.

(2) "Preparation of Coated Samples"

To the above-described emulsion was applied an infrared sensitization by adding 30 mg/mol-Ag of infrared sensitizing dye D-5. Furthermore, for super color sensitization and stabilization, disodium 4,4'-bis(4,6-dinaphtoxypyrimidin-2-ylamino)-stilbenzylsulfonate and 2,5-dimethyl-3-allylbenzothiazole iodide were added thereto in the amounts of 300 mg and 450 mg, respectively, to mol of silver.

Furthermore, after adding thereto 100 $mg/m^2$ of hydroquinone, a polyethylene acrylate latex in an amount of 25% of the gelatin binder, and 86 $mg/m^2$ of 2-bis(vinylsulfonylacetamido)ethane as a hardening agent, the emulsion was coated on a polyester film support at a silver coverage of 2.5 $g/m^2$ and a gelatin coverage of 1.0 $g/m^2$.

A coating composition containing 0.6 $g/m^2$ of gelatin, 60 $mg/m^2$ of polymethylmethacrylate having particle size of 2.5 μm and 70 $mg/m^2$ of colloidal silica having particle size of 10 μm as matting agents, and sodium dodecylbenzenesulfonate and the fluorine-containing surface active agent shown by formula (1) described above as coating aids, and a coating composition containing 0.4 $mg/^2m$ of gelatin, 225 $mg/m^2$ of a polyethylacrylate latex, 10 $mg/m^2$ of dye (2) shown above, 20 $mg/m^2$ of dye (3) shown above and sodium dodecylbenzenesulfonate were coated simultaneously on the emulsion layer as an upper protective layer and a lower protectively, respectively.

In addition, a back layer and a back protective layer were also formed as in Example 1.

Evaluation of Photographic Performance

Each sample obtained was exposed by a xenon flash light having a light emitting time of $10^{-6}$ second through an interference filter and a continuous wedge and subjected to a sensitometry at the temperature and time shown below using an automatic processor FG-710NH, made by Fuji Photo film Co., Ltd.

The developer and the fix solution were the same as those of Example 1.

| | | |
|---|---|---|
| Development | 38° C. | 11.6 sec. |
| Fix | 37° C. | 8 sec. |
| Wash | 26° C. | 7.5 sec. |
| Squeeze | | 2 sec. |
| Drying | 55° C. | 6.9 sec. |
| Total | | 36 sec. |

The logarithm of the exposure amount giving density 3.0 was employed as a measure of sensitivity and shown in Table 2 below as a relative sensitivity. Also, the inclination of the line passing through the point of density 0.1 and the point of density 3.0 in the characteristics curve was defined as gradation and shown in Table 2 below.

As shown in Table 2, it can be seen that as compared to Sample No. 1, comparison sample, by doping the silver halide grains with the compound of iron, osmium, ruthenium rhenium or rhodium, a higher sensitivity and higher contrast are obtained.

In addition, in regard to the processing reliance and remaining color, it was confirmed that they were allowable levels by the results of evaluations as in Example 1.

TABLE 2

| No. | Compound added to Solution 5: Compound | Amount (mol/Ag) | Relative Sensitivity | Gradation |
|---|---|---|---|---|
| 1 | — | — | 100 | 6.5 |
| 2 | $K_4Fe(CN)_6$ | $1 \times 10^{-5}$ | 136 | 6.8 |
| 3 | " | $3 \times 10^{-5}$ | 160 | 6.6 |
| 4 | $K_4Fe(CN)_6$ | " | 125 | 8.0 |
| | $(NH_4)RhCl_6$ | $5 \times 10^{-8}$ | | |
| 5 | $K_2Re(CN)_6$ | $1 \times 10^{-5}$ | 130 | 6.6 |
| 6 | $K_2Os(CN)_6$ | " | 135 | 6.8 |
| 7 | $K_2Ru(CN)_6$ | " | 128 | 7.0 |
| 8 | $K_4Fe(CN)_6$ | $3 \times 10^{-5}$ | 132 | 7.8 |
| | $K_3RuCl_6$ | $1 \times 10^{-7}$ | | |

EXAMPLE 3

(1) "Preparation of Coated Samples"

To each of Emulsions A, D, E, G, H, K, L and N prepared in Example 1 was applied an orthochromatographic sensitization by adding thereto 200 mg/mol-Ag of an orthochromatographic sensitizing dye A-1. Furthermore, for super color sensitization and stabilization, disodium 4,4-bis(2,6-dinophthoxyprimidin-4-yl-amino)-stilben-2,2'-disulfonate disdium salts and 2,5-dimethyl-3-allylbenzothiazole iodide were added thereto in the amounts of 300 mg and 450 mg, respectively, per mol of silver.

Furthermore, after adding thereto 100 mg/m$^2$ of hydroquinone, a polyethylacrylate latex in an amount of 25% of the gelatin binder and 86 mg/m$^2$ of 2-bis(vinylsulfonylacetamido)ethane, the emulsion was coated on a polyester film support at the gelatin coated amount and the silver coated amount as shown in Table 3 to provide coated samples 1 to 36. The coating composition containing 0.8 g/m$^2$ of gelatin, 60 mg/m$^2$ of polymethylmethacrylate having a particle size of 2.5 μm and 70 mg/m$^2$ of colloidal silica having a particle size of 10 μm as matting agents, and sodium dodecylbenzenesulfonate and the fluorine-containing surface active agent of formula (1) described above as coating aids were coated simultaneously on the emulsion layer.

In addition, the amount of gelatin described in Table 3 below is the sum of 0.8 g/m$^2$ of gelatin in the protective layer and the amount of gelatin in the emulsion layer.

Also, a back layer and a back protective layer having the same formulations as in Example 1 were also formed.

(2) "Evaluation of Samples"

i) Sensitivity and Gradation

The sensitivity and gradation were evaluated as in Example 1. In this case, however, each sample was exposed with a xenon flash lamp of $10^{-5}$ second through an interference filter having the peak at 488 n.m. In this case, the sensitivity of Sample No. 10 was shown as 100. The processing time was 11 seconds, 8 seconds, 7.5 seconds, 2 seconds and 7 seconds, i.e., the total processing time was 35.5 seconds.

ii) Processing Reliance iii) Evaluation of Remaining Color

Both were evaluated as in Example 1.

iv)

As is clear from the results shown in Table 3, it can be seen that for obtaining the effect of this invention, the amounts of gelatin, silver and iridium and the content of silver chloride described in the claim of the present invention are inevitable.

TABLE 3

| Sample No. | Iridium Content (mol/mol Ag) | Coated Amount of Gelatin (g/m$^2$) | Coated Amount of Ag (g/m$^2$) | Halogen** Composition | Sensitivity | Gradation | Processing Reliance ($\Delta S_{3.0}$) | Remaining Color | Note |
|---|---|---|---|---|---|---|---|---|---|
| 1 | — | 2.0 | 2.0 | $AgBrCl_{20}$ | 75 | 3.5 | 0.05 | X | Comparison |
| 2 | — | " | " | $AgBrCl_{60}$ | 85 | 3.5 | 0.04 | ○ | " |
| 3 | — | " | 3.5 | $AgBrCl_{20}$ | 80 | 4.0 | 0.07 | X | " |
| 4 | — | " | " | $AgBrCl_{60}$ | 85 | 4.5 | 0.06 | Δ | " |
| 5 | — | 3.0 | 2.0 | $AgBrCl_{20}$ | 70 | 3.0 | 0.08 | X | " |
| 6 | — | " | " | $AgBrCl_{60}$ | 80 | 2.5 | 0.06 | X | " |
| 7 | — | " | 3.5 | $AgBrCl_{20}$ | 75 | 4.0 | 0.07 | XX | " |
| 8 | — | " | " | $AgBrCl_{60}$ | 85 | 4.0 | 0.06 | X | " |
| 9 | $3 \times 10^{-8}$ | 2.0 | 2.0 | $AgBrCl_{20}$ | 85 | 4.5 | 0.05 | Δ | " |
| 10 | " | " | " | $AgBrCl_{60}$ | 100 | 6.5 | 0.02 | ⊙ | Invention |
| 11 | " | " | 3.5 | $AgBrCl_{20}$ | 90 | 4.5 | 0.06 | Δ | Comparison |
| 12 | " | " | " | $AgBrCl_{60}$ | 100 | 6.5 | 0.05 | Δ | " |
| 13 | " | 3.0 | 2.0 | $AgBrCl_{20}$ | 70 | 5.0 | 0.07 | X | " |
| 14 | " | " | " | $AgBrCl_{60}$ | 85 | 7.0 | 0.05 | ○ | " |
| 15 | " | " | 3.5 | $AgBrCl_{20}$ | 70 | 4.5 | 0.06 | XX | " |
| 16 | $3 \times 10^{-8}$ | 3.0 | 3.5 | $AgBrCl_{60}$ | 90 | 6.5 | 0.05 | X | Comparison |
| 17 | $3 \times 10^{-7}$ | 2.0 | 2.0 | $AgBrCl_{20}$ | 90 | 5.0 | 0.07 | ○ | " |
| 18 | " | " | " | $AgBrCl_{60}$ | 105 | 6.5 | 0.01 | ⊙ | Invention |
| 19 | " | " | 3.5 | $AgBrCl_{20}$ | 85 | 4.0 | 0.08 | X | Comparison |
| 20 | " | " | " | $AgBrCl_{60}$ | 100 | 6.5 | 0.04 | XX | " |
| 21 | " | 3.0 | 2.0 | $AgBrCl_{20}$ | 80 | 4.0 | 0.09 | X | " |
| 22 | " | " | " | $AgBrCl_{60}$ | 100 | 5.5 | 0.05 | Δ | " |
| 23 | " | " | 3.5 | $AgBrCl_{20}$ | 80 | 4.0 | 0.09 | X | " |
| 24 | " | " | " | $AgBrCl_{60}$ | 90 | 6.5 | 0.06 | Δ | " |
| 25 | $3 \times 10^{-8}$ | 2.0 | 2.0 | $AgBrCl_{20}$ | 90 | 4.5 | 0.05 | Δ | " |
| 26 | " | " | " | $AgBrCl_{60}$ | 100 | 6.5 | 0.02 | ⊙ | Invention |
| 27 | " | " | 3.5 | $AgBrCl_{20}$ | 80 | 4.5 | 0.10 | XX | Comparison |
| 28 | " | " | " | $AgBrCl_{60}$ | 85 | 6.5 | 0.04 | Δ | " |
| 29 | " | 3.0 | 2.0 | $AgBrCl_{20}$ | 80 | 4.5 | 0.08 | Δ | " |

TABLE 3-continued

| Sample No. | Iridium Content (mol/mol Ag) | Coated Amount of Gelatin ($g/m^2$) | Coated Amount of Ag ($g/m^2$) | Halogen** Composition | Sensitivity | Gradation | Processing Reliance ($\Delta S_{3.0}$) | Remaining Color | Note |
|---|---|---|---|---|---|---|---|---|---|
| 30 | " | " | " | $AgBrCl_{60}$ | 85 | 6.0 | 0.04 | X | " |
| 31 | $3 \times 10^{-8}$ | 3.0 | 3.5 | $AgBrCl_{20}$ | 85 | 4.0 | 0.12 | X | Comparison |
| 32 | " | " | " | $AgBrCl_{60}$ | 80 | 5.5 | 0.10 | XX | " |
| 33 | " | 2.0 | 2.5 | $AgBrCl_{40}$ | 95 | 6.5 | 0.02 | ◎ | Invention |
| 34 | " | " | " | $AgBrCl_{80}$ | 100 | 6.5 | 0.01 | ○ | " |
| 35 | " | " | 1.5 | " | 95 | 6.0 | 0.02 | ◎ | " |
| 36 | " | " | 3.1 | " | 100 | 6.5 | 0.04 | Δ | Comparison |

**Containing 0.15% per mol Ag of silver bromide

EXAMPLE 4

(1) "Preparation of Emulsion"

By following the same procedure for preparing Emulsion E in Example 1 except that the compound of iron, ruthenium, ismium, rhenium or rhodium was added to solution 5 in the amount shown in Table 4 below, a chlorobromide emulsion containing 80 mol %/mol-Ag of silver chloride and having a mean grain size of 0.2 μm was prepared. Emulsion P.

(2) "Preparation of Coated Samples"

To Emulsion P described above was applied an orthochromatic sensitization by adding thereto 200 mg/mol-Ag of an orthochromatic sensitizing dye A-1. Furthermore, for the super color sensitization and stabilization, disodium 4,4-bis(2,6-dinophthoxyprimidin-4-yl-amino)-stilben-2,2'-disulfonate disdium salts and 2,5-dimethyl-3-allylbenzothiazole iodide were added thereto in the amounts of 300 mg and 450 mg, respectively, per mol of silver.

Furthermore, after adding thereto 100 $mg/m^2$ of hydroquinone, a polyethylacrylate latex in an amount of 25% of the gelatin binder and 86 $mg/m^2$ of 2-bis(vinylsulfonylacetamido)ethane and also after adding thereto gelatin, the emulsion was coated on a polyester film support at a silver coverage of 2.8 $g/m^2$ and a gelatin coverage of 1.5 $g/m^2$. In this case, a coating composition containing 0.8 $g/m^2$ of gelatin, 60 $mg/m^2$ of polymethylmethacrylate having a particle size of 2.5 μm and 70 $mg/m^2$ of colloidal silica having a particle size of 10 μm as matting agents, sodium dodecylbenzenesulfonate and the fluorine-containing surface active agent of formula (1) described above as coating aids were coated simultaneously on the emulsion layer as a protective layer.

Also, a back layer and a back protective layer having the same compositions as in Example 1 were also formed.

(3) "Evaluation of Samples"

The evaluation was carried out as in Example 3 and the results obtained are shown in Table 4 below.

TABLE 4

| No. | Compound added to Solution 5: Compound | Compound added to Solution 5: Amount | Emulsion | Sensitivity*) | Gradation | Processing Reliance | Remaining Color | Note |
|---|---|---|---|---|---|---|---|---|
| 1 | — | — | P | 100 | 6.5 | 0.02 | ○ | Comparison |
| 2 | $K_4Fe(CN)_6$ | $1 \times 10^{-5}$ | " | 120 | 6.5 | 0.02 | ○ | Invention |
| 3 | " | $1 \times 10^{-2}$ | " | 80 | 5.0 | 0.02 | ○ | Comparison |
| 4 | $K_4Fe(CN)_6$ | $3 \times 10^{-5}$ | " | 110 | 7.5 | 0.01 | ○ | Invention |
| | $(NH_4)_3RhCl_6$ | $5 \times 10^{-8}$ | | | | | | |
| 5 | $K_2Re(CN)_6$ | $1 \times 10^{-5}$ | " | 130 | 6.5 | 0.02 | ○ | " |
| 6 | $K_2Os(CN)_6$ | " | " | 120 | 6.8 | 0.02 | ○ | " |
| 7 | $K_2Ru(CN)_6$ | " | " | 140 | 6.5 | 0.02 | ○ | " |
| 8 | $K_4Fe(CN)_6$ | $3 \times 10^{-5}$ | " | 120 | 7.5 | 0.02 | ○ | " |
| | $K_3RuCl_6$ | $1 \times 10^{-7}$ | | | | | | |

*)Shown by a relative value with the sensitivity of Sample No. 1 being 100.

As is clear from Table 4, it can be seen that by using the above-described metals, a high sensitivity and a high contrast are obtained without reducing the performance.

EXAMPLE 5

(1) "Preparation of Coated Samples"

To each of Emulsions B, C, E, F, I, J, K, and L prepared in Example 1 was applied a panchromatic sensitization by adding thereto 100 mg/mol-Ag of a panchromatic sensitizing dye B-2. Furthermore, for the super color sensitization and stabilization, disodium 4,4-bis(2,6-dinophthoxyprimidin-4-yl-amino)-stilben-2,2'-disulfonate disdium salts and 2,5-dimethyl-3-allylbenzothiazole iodide were added thereto in the amounts of 300 mg and 450 mg, respectively, per mol of silver.

Furthermore, after adding thereto 100 $mg/m^2$ of hydroquinone, a polyethyl acrylate latex in an amount of 25% of the gelatin binder and 86 $mg/m^2$ of 2-bis(vinylsulfonylacetamido)ethane as a hardening agent and after adding thereto gelatin, the emulsion was coated on a polyester film support at the gelatin coated amount and the silver coated amount shown in Table 5 below. In this case, a coating composition containing 0.5 $g/m^2$ of gelatin, 60 $mg/m^2$ of polymethylmethacrylate having a particle size of 2.5 μm and 70 $mg/m^2$ of colloidal silica having a particle size of 10 μm as matting agents, sodium dodecylbenzenesulfonate and the fluorine-containing surface active agent of formula (1) described above were coated simultaneously on the emulsion layer.

In addition, the amount of gelatin in Table 5 is the sum of 0.5 $g/m^2$ of gelatin in the protective layer and the amount of gelatin in the emulsion layer.

Also, a back layer and a back protective layer having the same compositions as in Example 1 were also formed.

(2) "Evaluation of Samples"

i) Sensitivity and Gradation

They were evaluated as in Example 1.

In addition, in this case, i) Each sample was exposed with a xenon flash lamp of $10^{-5}$ second through an interference film having the peak at 633 n.m.

ii) The sensitivity of Sample No. 13 was defined as 100.

The processing reliance and the remaining color were also evaluated as in Example 1. The results obtained are shown in Table 5.

TABLE 5

| Sample No. | Halogen* Composition (mol/mol Ag) | Iridium Content ($g/m^2$) | Coated Amount of Ag ($g/m^2$) | Coated Amount of Gelatin | Sensitivity | Gradation | Processing Reliance (ΔlogE) | Remaining Color | Note |
|---|---|---|---|---|---|---|---|---|---|
| 1 | $AgBrCl_{20}$ | $3 \times 10^{-5}$ | 2.0 | 2.5 | 70 | 4.0 | 0.10 | Δ | Comparison |
| 2 | " | " | " | 3.5 | 75 | 4.0 | 0.12 | X | " |
| 3 | " | " | 3.5 | 2.5 | 60 | 3.5 | 0.08 | X | " |
| 4 | " | " | " | 3.5 | 65 | 4.0 | 0.09 | XX | " |
| 5 | " | $3 \times 10^{-7}$ | 2.0 | 2.5 | 80 | 6.5 | 0.02 | Δ | " |
| 6 | " | " | " | 3.5 | 85 | 6.5 | 0.04 | Δ | " |
| 7 | " | " | 3.5 | 2.5 | 75 | 6.0 | 0.09 | X | " |
| 8 | " | " | " | 3.5 | 80 | 6.5 | 0.10 | XX | " |
| 9 | $AgBrCl_{40}$ | $3 \times 10^{-5}$ | 2.0 | 2.5 | 80 | 4.5 | 0.07 | ○ | " |
| 10 | " | " | " | 3.5 | 80 | 4.5 | 0.08 | Δ | " |
| 11 | " | " | 3.5 | 2.5 | 70 | 4.0 | 0.10 | X | " |
| 12 | " | " | " | 3.5 | 75 | 4.5 | 0.11 | X | " |
| 13 | " | $3 \times 10^{-7}$ | 2.0 | 2.5 | 100 | 7.0 | 0.01 | ○ | Invention |
| 14 | " | " | " | 3.5 | 105 | 7.0 | 0.02 | Δ | Comparison |
| 15 | " | " | 3.5 | 2.5 | 90 | 6.0 | 0.08 | ○ | " |
| 16 | $AgBrCl_{40}$ | $3 \times 10^{-7}$ | 3.5 | 3.5 | 95 | 6.0 | 0.09 | X | Comparison |
| 17 | $AgBrCl_{60}$ | $3 \times 10^{-5}$ | 2.0 | 2.5 | 80 | 5.0 | 0.09 | ○ | " |
| 18 | " | " | " | 3.5 | 80 | 5.0 | 0.10 | Δ | " |
| 19 | " | " | 3.5 | 2.5 | 75 | 4.0 | 0.07 | X | " |
| 20 | " | " | " | 3.5 | 75 | 4.5 | 0.06 | X | " |
| 21 | " | $3 \times 10^{-7}$ | 2.0 | 2.5 | 100 | 6.5 | 0.02 | ◎ | Invention |
| 22 | " | " | " | 3.5 | 100 | 7.0 | 0.04 | Δ | Comparison |
| 23 | " | " | 3.5 | 2.5 | 90 | 5.5 | 0.05 | Δ | " |
| 24 | " | " | " | 3.5 | 95 | 5.5 | 0.06 | X | " |
| 25 | $AgBrCl_{80}$ | $3 \times 10^{-5}$ | 2.0 | 2.5 | 80 | 4.5 | 0.07 | ◎ | " |
| 26 | " | " | " | 3.5 | 80 | 4.5 | 0.07 | Δ | " |
| 27 | " | " | 3.5 | 2.5 | 70 | 4.0 | 0.08 | Δ | " |
| 28 | " | " | " | 3.5 | 75 | 4.5 | 0.10 | X | " |
| 29 | " | $3 \times 10^{-7}$ | 2.0 | 2.5 | 105 | 6.5 | 0.01 | ◎ | Invention |
| 30 | " | " | " | 3.5 | 105 | 7.0 | 0.02 | Δ | Comparison |
| 31 | $AgBrCl_{80}$ | $3 \times 10^{-7}$ | 3.5 | 2.5 | 95 | 5.5 | 0.06 | X | Comparison |
| 32 | " | " | " | 3.5 | 100 | 5.5 | 0.09 | XX | " |
| 33 | $AgBrCl_{40}$ | $3 \times 10^{-7}$ | 1.0 | 2.7 | 105 | 6.5 | 0.01 | ◎ | Invention |
| 34 | " | " | 2.5 | " | 100 | 7.0 | 0.02 | ○ | " |
| 35 | " | " | 3.5 | " | " | 6.5 | 0.08 | Δ | " |
| 36 | " | " | " | 2.0 | " | 7.0 | 0.02 | ◎ | Invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having thereon, on the same side of the support, at least one light-sensitive silver halide emulsion layer and at least one light-insensitive hydrophilic colloid layer, wherein the amount of gelatin on the side of the support with the at least one light-sensitive silver halide emulsion layer and the at least one light-sensitive hydrophilic colloid layer is greater than 0 and less than or equal to 2.5 $g/m^2$ and the coated amount of silver on the side of the support with the at least one light-insensitive silver halide emulsion layer and the at least one light-insensitive hydrophilic colloid layer is greater than 0 and less than or equal to 3.0 $g/m^2$, and the silver halide grains comprise at least 30 mol % silver chloride, not more than 5 mol % silver iodide, and greater than 0 and less than or equal to $1 \times 10^{-5}$ mol of an iridium compound per mol of the silver halide.

2. The silver halide photographic element of claim 1, wherein the silver halide grains contain at least one of an iron, rhenium, ruthenium, rhodium or osmium compound in an amount of $1 \times 10^{-6}$ to $1 \times 10^{-3}$ mol % based on the amount of silver.

3. The silver halide photographic element of claim 1, wherein said emulsion is sensitized chemically or spectrally.

4. The silver halide photographic element of claim 1, wherein the silver halide grains comprise at least 60 mol % of silver chloride.

5. The silver halide photographic element of claim 1, wherein the silver halide grains comprise not more than 2 mol % of silver iodide.

6. The silver halide photographic element of claim 1, wherein the silver halide grains comprise $1 \times 10^{-8}$ to $1 \times 10^{-5}$ mol of the iridium compound.

7. The silver halide photographic element of claim 1, wherein the silver halide grains comprise $5 \times 10^{-8}$ to $5 \times 10^{-6}$ mol of the iridium compound.

* * * * *